US010092100B1

(12) United States Patent
Chen et al.

(10) Patent No.: US 10,092,100 B1
(45) Date of Patent: Oct. 9, 2018

(54) SLIDE RAIL ASSEMBLY

(71) Applicants: KING SLIDE WORKS CO., LTD., Kaohsiung (TW); KING SLIDE TECHNOLOGY CO., LTD., Kaohsiung (TW)

(72) Inventors: Ken-Ching Chen, Kaohsiung (TW); Shun-Ho Yang, Kaohsiung (TW); Chih-Hsin Yeh, Kaohsiung (TW); Chun-Chiang Wang, Kaohsiung (TW)

(73) Assignees: KING SLIDE WORKS CO., LTD., Kaohsiung (TW); KING SLIDE TECHNOLOGY CO., LTD., Kaohsiung (TW)

( * ) Notice: Subject to any disclaimer, the term of this patent is extended or adjusted under 35 U.S.C. 154(b) by 0 days.

(21) Appl. No.: 15/861,684

(22) Filed: Jan. 4, 2018

(30) Foreign Application Priority Data

Jun. 23, 2017 (TW) ..... 106121325 A

(51) Int. Cl.
*A47B 88/00* (2017.01)
*A47B 88/493* (2017.01)
*A47B 88/57* (2017.01)

(52) U.S. Cl.
CPC ..... *A47B 88/493* (2017.01); *A47B 88/57* (2017.01); *A47B 2210/0018* (2013.01); *A47B 2210/0032* (2013.01)

(58) Field of Classification Search
CPC ..... A47B 2210/0016; A47B 2210/0018
USPC ..... 312/334.44, 334.46
See application file for complete search history.

(56) References Cited

U.S. PATENT DOCUMENTS

| | | | | |
|---|---|---|---|---|
| 2,730,423 | A * | 1/1956 | Mock | A47B 88/57 16/82 |
| 3,923,347 | A | 12/1975 | Dean | |
| 4,469,384 | A | 9/1984 | Fler | |
| 4,932,792 | A | 6/1990 | Baxter | |
| 5,671,988 | A * | 9/1997 | O'Neill | A47B 88/467 312/333 |
| 5,757,109 | A | 5/1998 | Parvin | |
| 6,126,255 | A | 10/2000 | Yang | |
| 6,435,636 | B1 * | 8/2002 | MacMillan | A47B 88/467 312/333 |
| 7,086,708 | B2 | 8/2006 | Tseng | |
| 7,458,651 | B1 | 12/2008 | Radke | |
| 8,152,251 | B2 | 4/2012 | Huang | |
| 2003/0111942 | A1 * | 6/2003 | Judge | H05K 7/1421 312/334.46 |

(Continued)

FOREIGN PATENT DOCUMENTS

| | | |
|---|---|---|
| FR | 2.203.269 | 5/1974 |
| WO | 00/78183 A1 | 12/2000 |

*Primary Examiner* — Matthew W Ing
(74) *Attorney, Agent, or Firm* — Winston Hsu

(57) ABSTRACT

A slide rail assembly includes a first rail, a second rail and a holding member. The second rail has an engaging portion. The holding member is mounted to the first rail. The holding member has an elastic section and a holding section. The holding section protrudes from the elastic section by a height. When the second rail is located in a retracted position relative to the first rail, the engaging portion of the second rail engages with the holding section of the holding member. When the second rail is moved away from the retracted position relative to the first rail, the engaging portion of the second rail disengages from the holding section of the holding member.

13 Claims, 7 Drawing Sheets

(56) References Cited

U.S. PATENT DOCUMENTS

| | | | |
|---|---|---|---|
| 2006/0091771 | A1 | 5/2006 | Teskey |
| 2006/0226747 | A1 | 10/2006 | Beaudoin |

* cited by examiner

SLIDE RAIL ASSEMBLY

BACKGROUND OF THE INVENTION

1. Field of the Invention

The present invention relates to a slide rail assembly, and more particularly, to a slide rail assembly capable of being held in a retracted position.

2. Description of the Prior Art

In general, a slide rail assembly includes at least one two-section slide implemented in a drawer or in a chassis. The two-section slide is configured to the drawer for facilitating the drawer to be pulled out from a cabinet, or the two-section slide is configured to the chassis for facilitating the chassis to be pulled out from a rack. It results in ease of maintenance and usage of the cabinet and the rack.

A conventional locking mechanism is used for fixing the slide rail assembly in a retracted position. In operation, a release mechanism is in cooperation with the locking mechanism for releasing the sliding rail assembly from the retracted position. In such a manner, the slide rail assembly is able to extend from the retracted position to an extended position. However, the aforesaid design with the lock mechanism in cooperation with the release mechanism is more complicated and has the disadvantage of high cost.

Another way to fix the slide rail assembly in the retracted position is to configure a soft cushion member at an end of one of rails of the slide rail assembly. When another rail is retracted relative to the rail with the soft cushion member, the other rail rubs the soft cushion member, so as to fix the slide rail assembly in the retracted position. However, with a number of extraction and retraction of the slide rail assembly increases, abrasion of the soft cushion member increases as well, which reduces neither the friction nor the fixing capability between the soft cushion member and the other rail. Accordingly, it reduces stability of mechanism of the slide rail assembly in the retracted position. The aforesaid design of the slide rail assembly with the soft cushion member is disclosed in US patents with U.S. Pat. No. 7,086,708 B2 as well as U.S. Pat. No. 8,152,251 B2, and are proposed herein for reference.

SUMMARY OF THE INVENTION

Thus, the present invention provides a slide rail assembly for solving above drawbacks.

According to an embodiment of the present invention, a slide rail assembly includes a first rail, a second rail and a holding member. The second rail has an engaging portion. The holding member is configured to the first rail. The holding member has an elastic section and a holding section, and the holding section protrudes from the elastic section by a height. When the second rail is located in a retracted position relative to the first rail, the engaging portion of the second rail engages with the holding section of the holding member. When the second rail is moved away from the retracted position relative to the first rail, the engaging portion of the second rail disengages from the holding section of the holding member.

Preferably, the engaging portion of the second rail is a hole.

Preferably, the second rail has a first edge wall and a second edge wall. The first edge wall and the second edge wall cooperatively define the hole. The holding section of the holding member has a first side and a second side. The first side corresponds to the first edge wall, and the second side corresponds to the second edge wall.

Preferably, the slide rail assembly further includes a first guiding structure disposed on one of the first edge wall of the second rail and the first side of the holding section of the holding member.

Preferably, the slide rail assembly further includes a second guiding structure disposed on one of the second edge wall of the second rail and the second side of the holding section of the holding member.

Preferably, the slide rail assembly further includes a third rail movably disposed between the first rail and the second rail, and the third rail is for elongating an extracting movement of the second rail relative to the first rail.

Preferably, the first rail includes a pair of first lateral walls and a first central wall. The first central wall is arranged between the pair of first lateral walls and connects one of the pair of first lateral walls with the other of the pair of first lateral walls. The pair of first lateral walls and the first central wall cooperatively define a first passage. The slide rail assembly further includes a first sliding assistant device. The first sliding assistant device is arranged in the first passage and configured to the pair of the first lateral walls of the first rail. The first sliding assistant device has a plurality of rolling balls for facilitating the third rail to displace relative to the first rail.

Preferably, the third rail includes a pair of second lateral walls and a second central wall. The second central wall is arranged between the pair of second lateral walls and connects one of the pair of second lateral walls with the other of the pair of second lateral walls. The pair of second lateral walls and the second central wall cooperatively define a second passage. The slide rail assembly further includes a second sliding assistant device. The second sliding assistant device is arranged in the second passage and configured to the pair of the second lateral walls of the third rail. The second sliding assistant device has a plurality of rolling balls for facilitating the second rail to displace relative to the third rail.

Preferably, the holding member is configured in a position adjacent to a rear end of the first rail.

Preferably, the holding member has a base plate. The base plate is securely configured in the position adjacent to the rear end of the first rail, and the elastic section of the holding member extends from the base plate.

Preferably, the holding member is an elastic member made of metal material.

Preferably, the holding member has a stop portion corresponding to a rear end of the third rail, and the stop portion is for stopping the third rail when the third rail is located in the retracted position relative to the first rail.

Preferably, the holding member is securely configured to the central wall of the first rail.

These and other objectives of the present invention will no doubt become obvious to those of ordinary skill in the art after reading the following detailed description of the preferred embodiment that is illustrated in the various figures and drawings.

DETAILED DESCRIPTION

Figure 7:
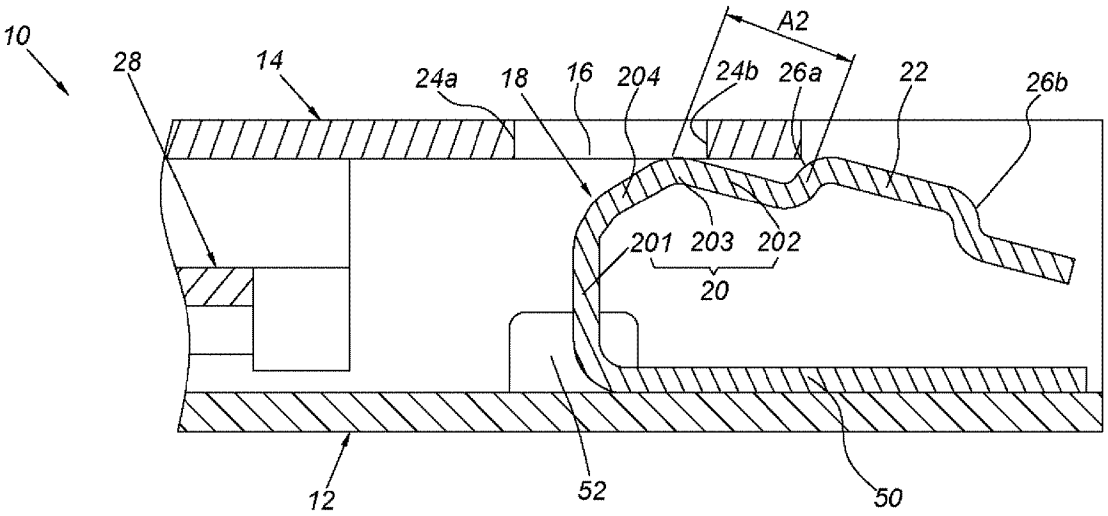
FIG. 7 is a diagram illustrating the second rail being extracted to a second position according to the embodiment of the present invention.

FIG. 1 to FIG. 4 illustrates a slide rail assembly 10 according to an embodiment of the present invention. The slide rail assembly 10 includes a first rail 12, a second rail 14 and a holding member 18. The second rail 14 has an engaging portion 16. The holding member 18 is configured to the first rail 12. The holding member 18 has an elastic section 20 and a holding section 22, and the holding section 22 protrudes from the elastic section 20 by a height h. When the second rail 14 is located in a retracted position relative to the first rail 12, the engaging portion 16 of the second rail 14 engages with the holding section 22 of the holding member 18, so that the second rail 14 is retained in a retracted position P1 relative to the first rail 12. When the second rail 14 is moved away from the retracted position P1 relative to the first rail 12, e.g., when the second rail 14 is extracted from the first rail 12, the engaging portion 16 of the second rail 14 disengages from the holding section 22 of the holding member 18, as shown in FIG. 7.

Figure 1:
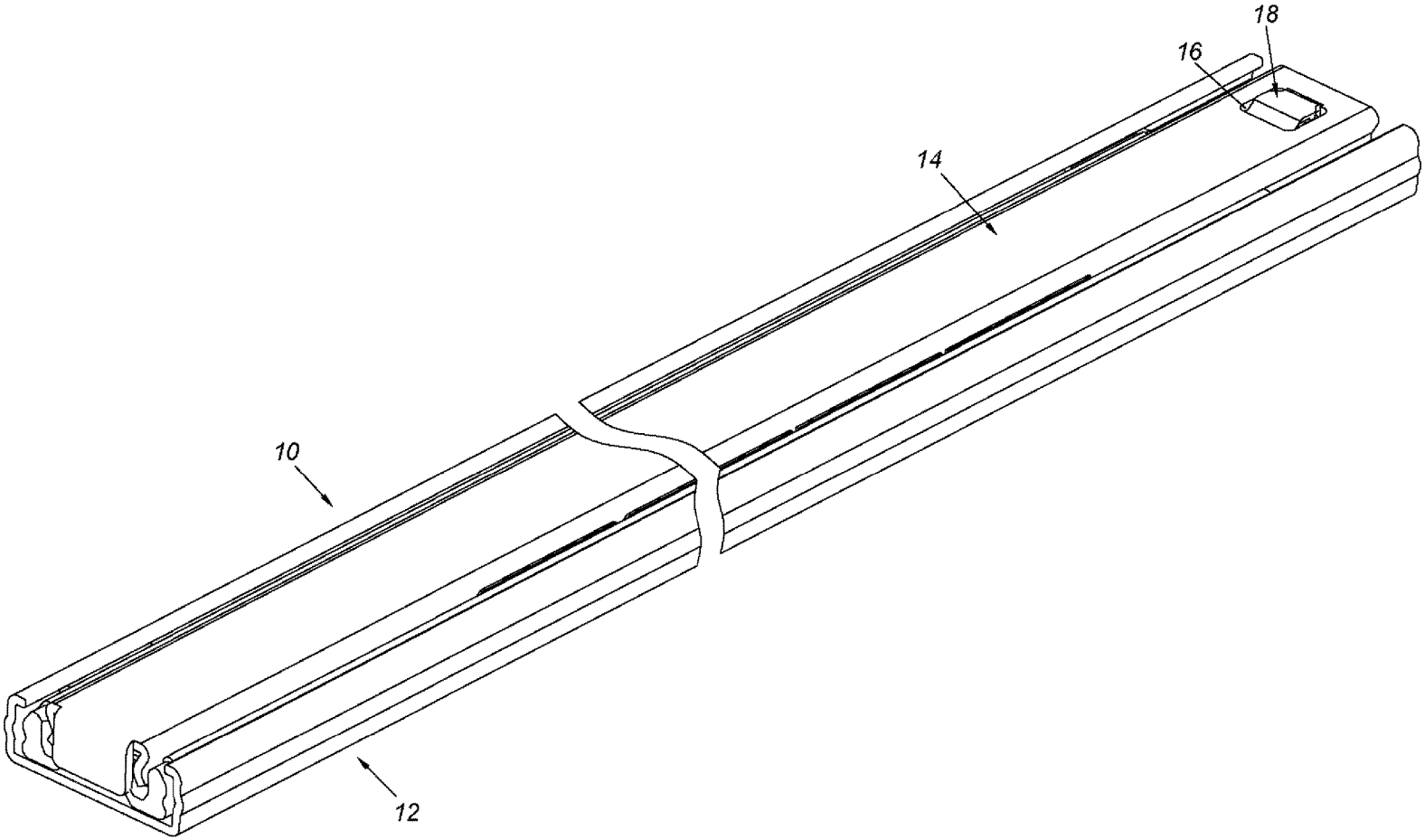
FIG. 1 is a diagram illustrating a slide rail assembly in a retracted status according to an embodiment of the present invention.
Figure 2:
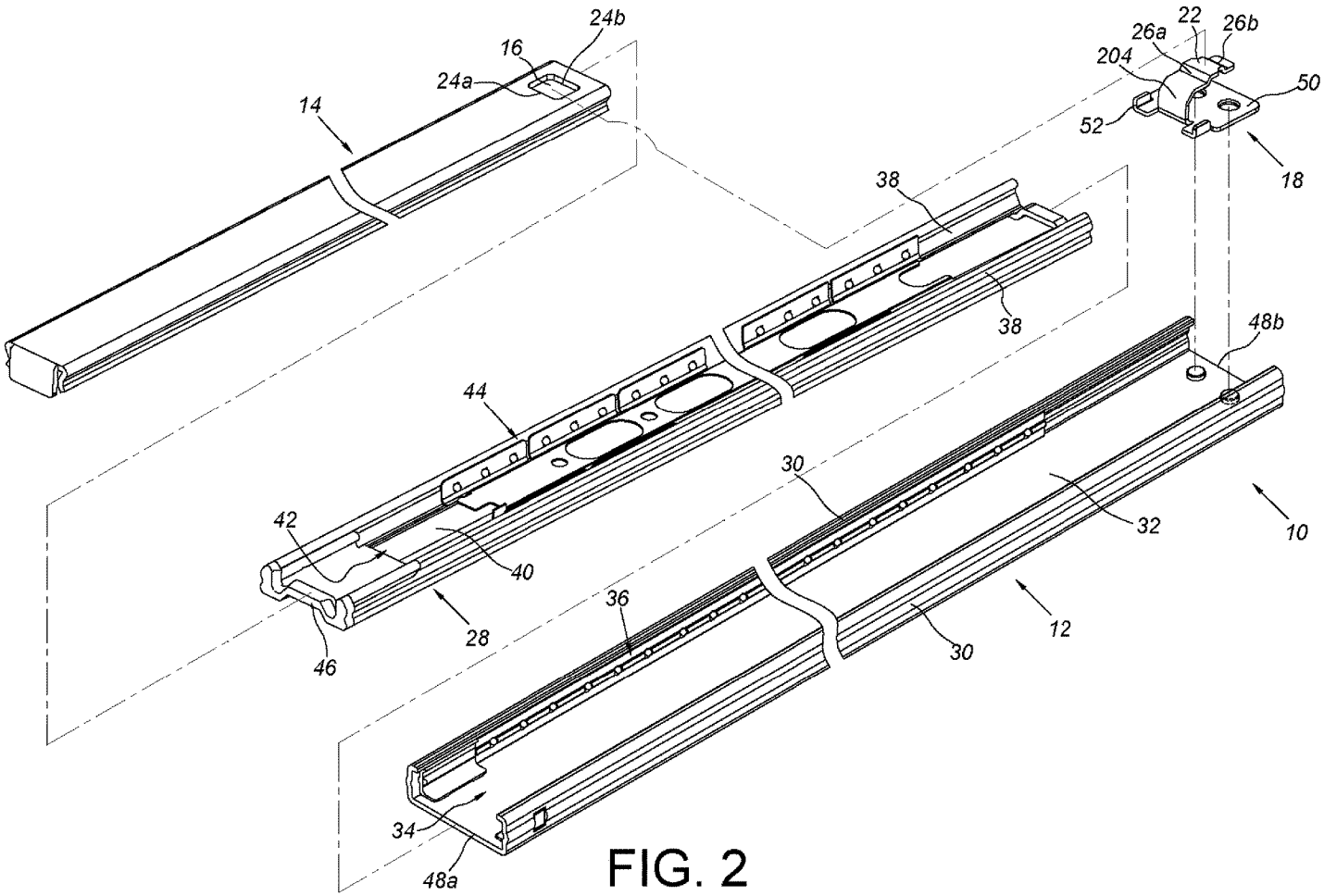
FIG. 2 is an exploded diagram of the slide rail assembly according to the embodiment of the present invention.

In a preferred embodiment, as shown in FIG. 2, the engaging portion 16 of the second rail 14 can be a hole, but the present invention is not limited thereto.

Figure 4:
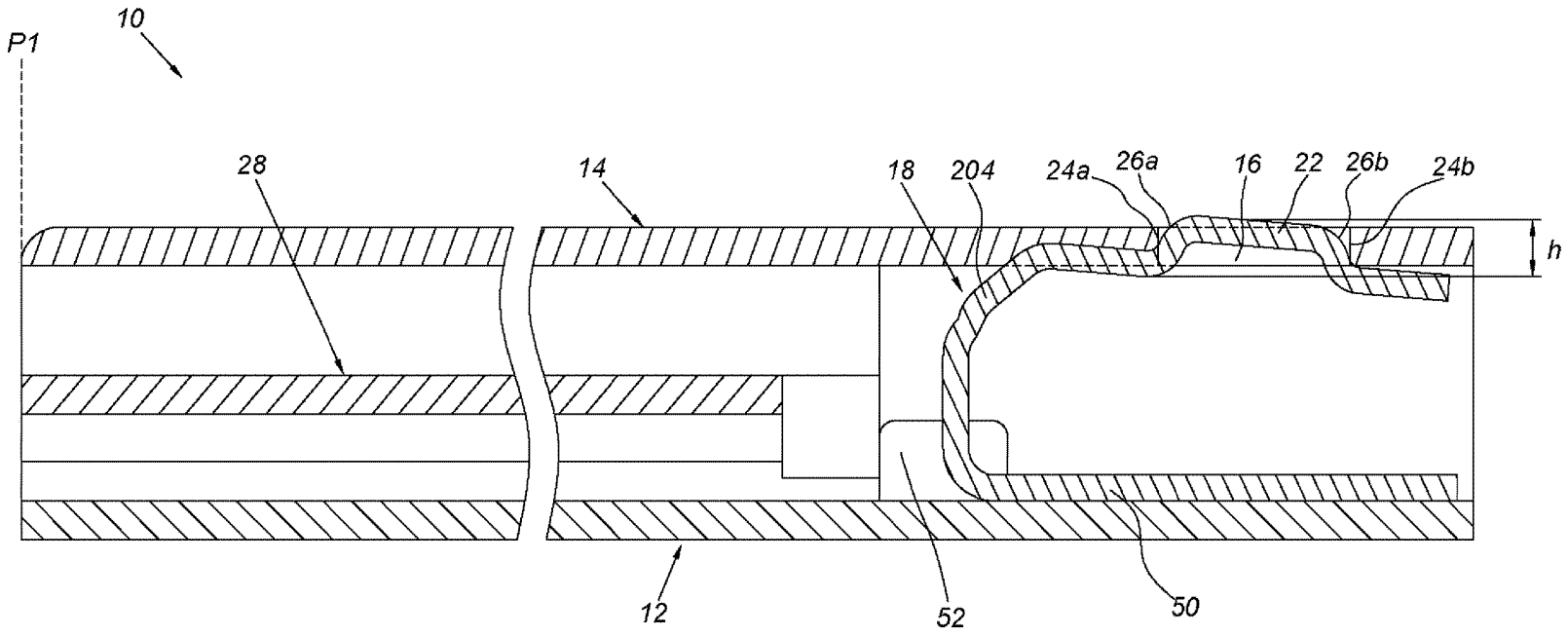
FIG. 4 is a diagram illustrating an engaging portion engaging with the holding member when the slide rail assembly is in a retracted position according to the embodiment of the present invention.

In a preferred embodiment, as shown in FIG. 4, the second rail 14 has a first edge wall 24*a* and a second edge wall 24*b*. The first edge wall 24*a* and the second edge wall 24*b* cooperatively define the engaging portion 16. The holding section 22 of the holding member 18 has a first side 26*a* and a second side 26*b*. The first side 26*a* corresponds to the first edge wall 24*a*, and the second side 26*b* corresponds to the second edge wall 24*b*.

In a preferred embodiment, as shown in FIG. 4, the slide rail assembly 10 further includes a first guiding structure, and the first guiding structure is disposed on one of the first edge wall 24*a* of the second rail 14 and the first side 26*a* of the holding section 22 of the holding member 18. In the present embodiment, the first guiding structure can be a first inclined surface (e.g., a chamfer structure) or an arc surface (e.g., a round structure), and the first inclined surface or the arc surface is disposed on the first side 26*a* of the holding section 22 of the holding member 18.

In a preferred embodiment, as shown in FIG. 4, the slide rail assembly 10 further includes a second guiding structure, and the second guiding structure is disposed on one of the second edge wall 24*b* of the second rail 14 and the second side 26*b* of the holding section 22 of the holding member 18. In the present embodiment, the second guiding structure can be a second inclined surface (e.g., a chamfer structure) or an arc surface (e.g., a round structure), and the second inclined surface or the arc surface is disposed on the second side 26*b* of the holding section 22 of the holding member 18.

Figure 3:
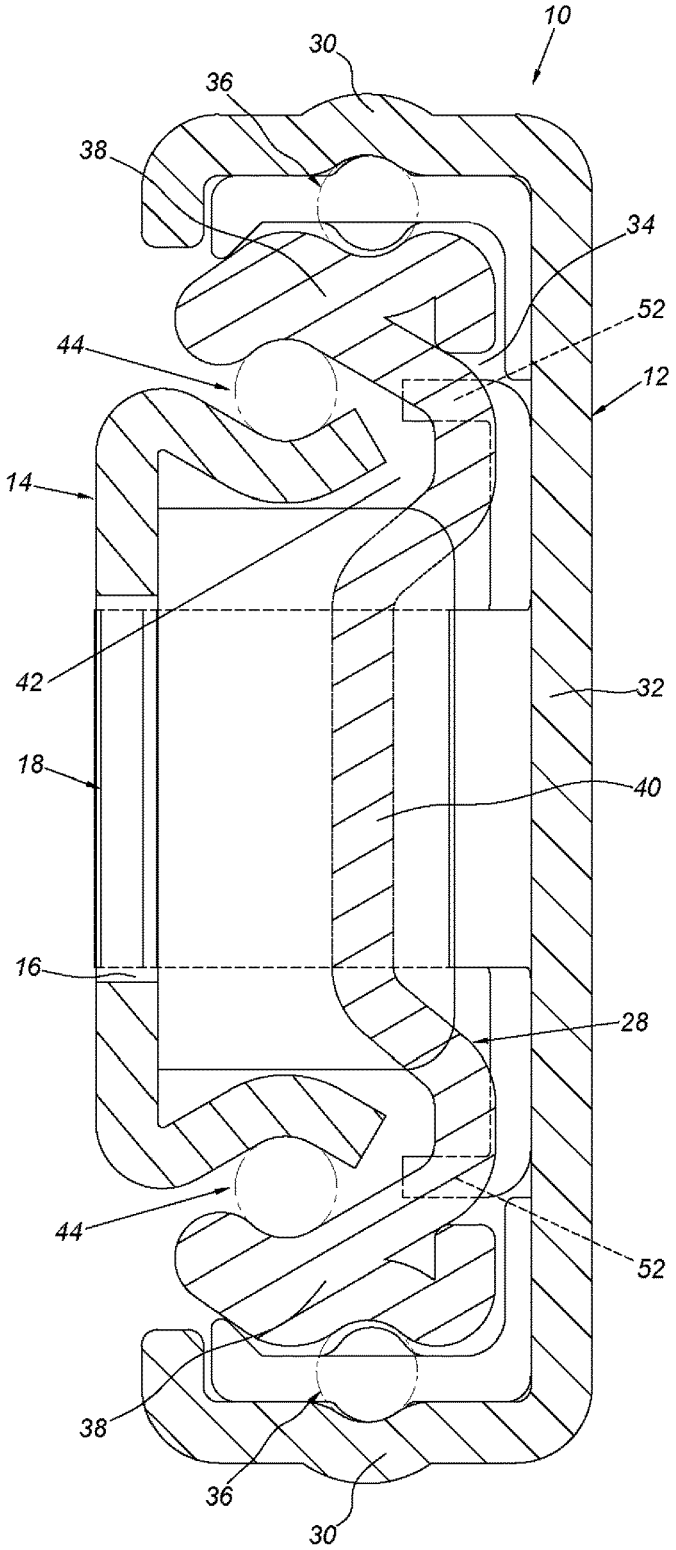
FIG. 3 is a section view of the slide rail assembly in an assembled status according to the embodiment of the present invention.

In a preferred embodiment, as shown in FIG. 2 to FIG. 4, the slide rail assembly 10 further includes a third rail 28. The third rail 28 is movably disposed between the first rail 12 and the second rail 14. The third rail 28 is for elongating an extracting movement of the second rail 14 relative to the first rail 12. In other words, in the present embodiment, the third rail 28 is disposed on the first rail 12 and slidable relative to the first rail 12, and the second rail 14 is disposed on the third rail 28 and slidable relative to the third rail 28. In such a manner, during the process that the second rail 14 is extracted from the first rail 12, the third rail 28 is extracted from the first rail 12 by a first extracting movement, and the second rail 14 is extracted from the third rail 28 by a second extracting movement. As a result, the third rail 28 allows a two-section extracting movement between the second rail 14 and the first rail 12, so as to elongate the extracting movement of the second rail 14 relative to the first rail 12.

In a preferred embodiment, as shown in FIG. 2 and FIG. 3, the first rail 12 includes a pair of first lateral walls 30 and a first central wall 32. The first central wall 32 is arranged between the pair of first lateral walls 30 and connects one of the pair of first lateral walls 30 with the other of the pair of first lateral walls 30. The pair of first lateral walls 30 and the first central wall 32 cooperatively define a first passage 34. The slide rail assembly 10 further includes a first sliding assistant device 36. The first sliding assistant device 36 is arranged in the first passage 34 and configured to the pair of the first lateral walls 30 of the first rail 12. The first sliding assistant device 36 has a plurality of rolling balls for facilitating the third rail 28 to displace relative to the first rail 12.

In a preferred embodiment, as shown in FIG. 2 and FIG. 3, the third rail 28 includes a pair of second lateral walls 38 and a second central wall 40. The second central wall 40 is arranged between the pair of second lateral walls 38 and connects one of the pair of second lateral walls 38 with the other of the pair of second lateral walls 38. The pair of second lateral walls 38 and the second central wall 40 cooperatively define a second passage 42. The slide rail assembly 10 further includes a second sliding assistant device 44. The second sliding assistant device 44 is arranged in the second passage 42 and configured to the pair of the second lateral walls 38 of the third rail 28. The second sliding assistant device 44 has a plurality of rolling balls for facilitating the second rail 14 to displace relative to the third rail 28. In addition, a stopping base 46 is securely disposed at a front end of the third rail 28. The stopping base 46 is for preventing the second sliding assistant device 44 from separating from the third rail 28.

In a preferred embodiment, as shown in FIG. 2, the first rail 12 has a front end 48*a* and a rear end 48*b*. The holding member 18 has a base plate 50. The base plate 50 is securely installed in the position adjacent to the rear end 48*b* of the first rail 12. The elastic section 20 of the holding member 18 extends from the base plate 50. Preferably, the holding member 18 is securely configured to the first central wall 32 of the first rail 12.

In a preferred embodiment, as shown in FIG. 2, the holding member 18 is an elastic member made of metal material.

In a preferred embodiment, as shown in FIG. 2 and FIG. 4, the holding member 18 has a stop portion 52. The stop portion 52 corresponds to a rear end of the third rail 28. When the third rail 28 is located in the retracted position P1 relative to the first rail 12, the stop portion 52 is for stopping the third rail 28 at the retracted position P1.

As shown in FIG. 4, when the second rail 14 is located in the retracted position P1 relative to the first rail 12, the holding section 22 of the holding member 18 elastically protrudes into the engaging portion 16 of the second rail 14, so that the holding section 22 of the holding member 18 engages with the first edge wall 24*a* and the second edge wall 24*b* of the second rail 14. In the meanwhile, the second rail 14 is able to be securely fixed in the retracted position P1, so that the second rail 14 is able to be securely retained in the retracted status relative to the first rail 12.

Figure 5:
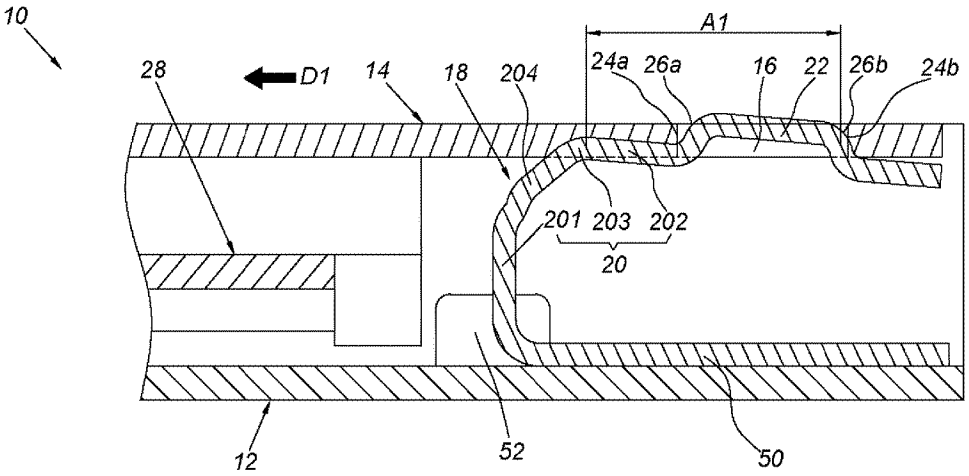
FIG. 5 is a diagram illustrating the engaging portion of a second rail abutting against a side of the holding member when the second rail is extracted from the retracted position to a first position according to the embodiment of the present invention.
Figure 6:
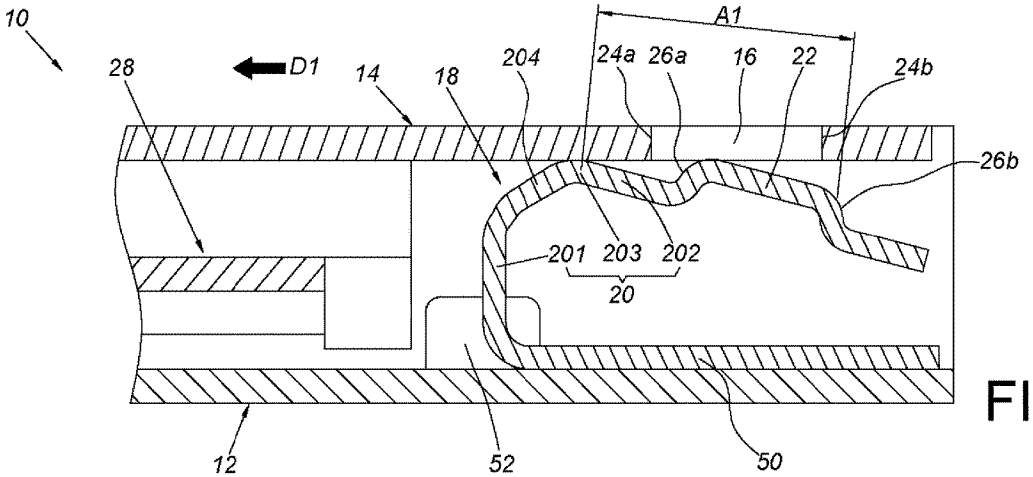
FIG. 6 is a diagram illustrating the holding member being deformed due to extracting displacement of the second rail according to the embodiment of the present invention.

As shown in FIG. 5 to FIG. 7, when the second rail 14 is extracted from the retracted position P1 and displaces relative to the first rail 12 in a first direction D1, the second side 26*b* of the holding section 22 of the holding member 18 is pressed by the second edge wall 24*b* of the second rail 14. The deformation of the elastic section 20 of the holding member 18 allows the holding section 22 of the holding member 18 to move away from the engaging portion 16 of the second rail 14. As a result, the second rail 14 is able to displace relative to the first rail 12 in the first direction D1 without structural constraint.

Figure 8:
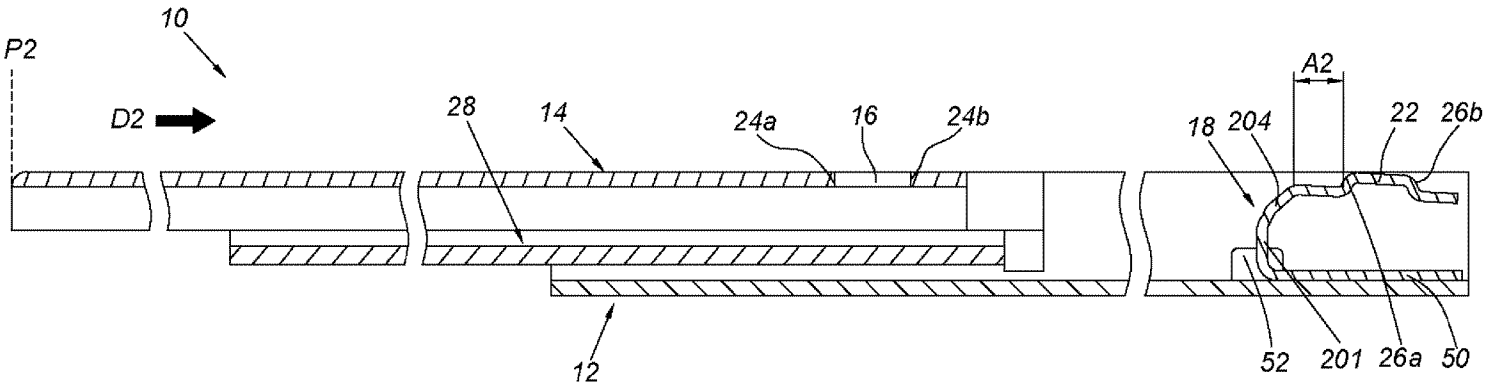
FIG. 8 is a diagram illustrating the slide rail assembly being retracted from an extended position to the retracted position according to the embodiment of the present invention.
Figure 9:
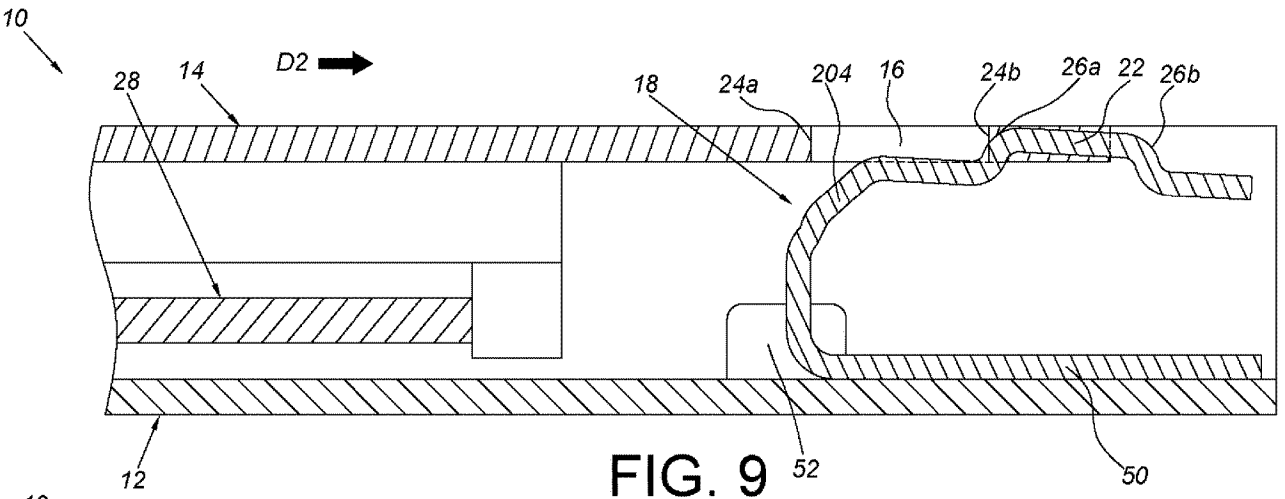
FIG. 9 is a diagram illustrating the engaging portion of the second rail abutting against the holding member when the second rail approaches the retracted position in a retracted direction according to the embodiment of the present invention.
Figure 10:
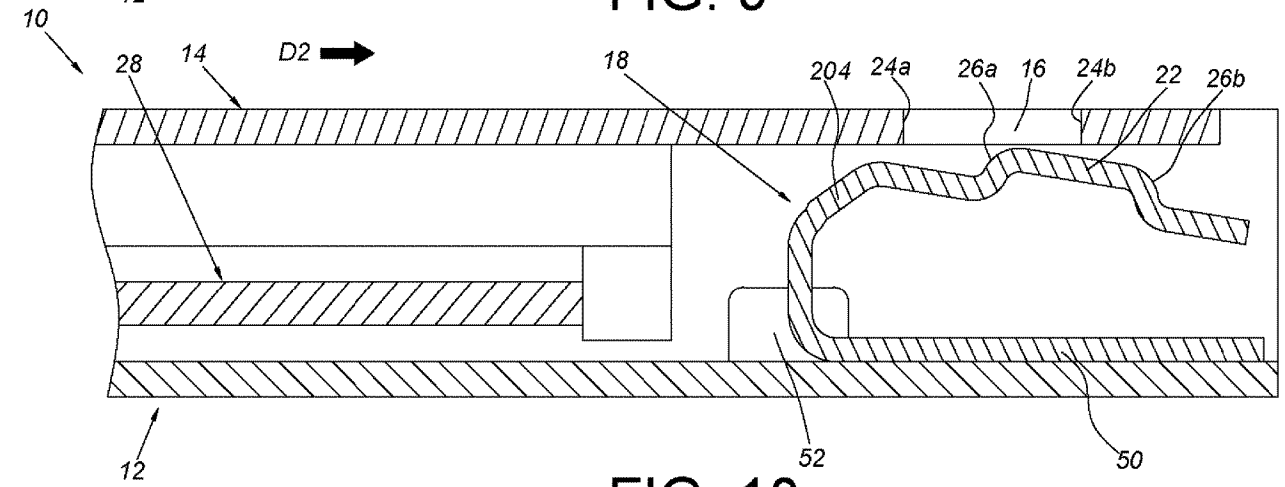
FIG. 10 is a diagram illustrating the holding member being deformed due to retracted displacement of the second rail according to the embodiment of the present invention.

As shown in FIG. 8 to FIG. 10, when the second rail 14 displaces relative to the first rail 12 from an extended position P2 to the retracted position P1 in a second direction D2, the first side 26*a* of the holding section 22 of the holding member 18 is pressed by the second edge wall 24*b* of the second rail 14. The elastic section 20 of the holding member 18 stores an elastic potential due to deformation of the elastic section 20. When the holding section 22 of the holding member 18 is moved to where the engaging portion 16 of the second rail 14 is located, the elastic section 20 of the holding member 18 releases the elastic potential, so as to generate an elastic recovery force. The elastic recovery force enables the holding section 22 of the holding member 18 to protrude into the engaging portion 16 of the second rail 14 and engages with the engaging portion 16, as shown in FIG. 4. As a result, the second rail 14 can be fixed in the retracted position P1 relative to the first rail 12 and securely retained in the retracted status.

It should be noticed that the elastic section 20 can include a first elastic portion 201, a second elastic portion 202 and a pivotal portion 203, as shown in FIG. 5 and FIG. 6. The first elastic portion 201 connects the base plate 50 and the pivotal portion 203. The second elastic portion 202 connects the pivotal portion 203 and the first side 26*a*. When the second rail 14 is extracted from the retracted position P1 and displaces relative to the first rail 12 in a first direction D1, the second side 26*b* of the holding section 22 of the holding member 18 is pressed by the second edge wall 24*b* of the second rail 14. In such a manner, the holding section 22 is rotated about the pivotal portion 203 and moves away from the engaging portion 16.

In practical application, a distance between the pivotal portion 203 of the elastic section 20 and the second side 26*b* of the holding section 22 can be defined as a first force arm A1. As shown in FIG. 5 and FIG. 6, when the second side 26*b* of the holding section 22 of the holding member 18 is pressed by the second edge wall 24*b* of the second rail 14, the holding section 22 is pivoted to the pivotal portion 203 to rotate toward the base plate 50, i.e., the first force arm A1 is viewed as a force arm that the holding section 22 rotates about the pivotal portion 203. Since the rigidity of the holding member 18 is a constant, a force applied to the second rail 14 for extracting from the first rail 12 can be adjusted by design of a length of the first force arm A1.

As shown in FIG. 7 and FIG. 8, when the second rail 14 displaces relative to the first rail 12 from the extended position P2 to the retracted position P1 in a second direction D2, the first side 26*a* of the holding section 22 of the holding member 18 is pressed by the second edge wall 24*b* of the second rail 14. In such a manner, the holding section 22 is rotated about the pivotal portion 203 and toward the base plate 50 for allowing the second rail 14 to move to the retracted position P1.

In practical application, a distance between the pivotal portion 203 of the elastic section 20 and the first side 26*a* of the holding section 22 can be defined as a second force arm A2. As shown in FIG. 7 and FIG. 8, when the first side 26*a* of the holding section 22 of the holding member 18 is pressed by the second edge wall 24*b* of the second rail 14, the holding section 22 is pivoted to the pivotal portion 203 to rotate toward the base plate 50, i.e., the second force arm A2 is viewed as a force arm that the holding section 22 rotates about the pivotal portion 203. Since the rigidity of the holding member 18 is a constant, a force applied to the second rail 14 for retracting from the extended position P2 into the first rail 12 can be adjusted by design of a length of the second force arm A2.

In addition, as shown in FIG. 7 and FIG. 8, a pressing assistant structure 204 is disposed on the first elastic portion 201 of the elastic section 20. The pressing assistant structure 204 facilitates the holding section 22 to be pressed by the second edge wall 24*b*, so that the second rail 14 is able to pass through the elastic section 20 in the second direction D2. In the present embodiment, the pressing assistant structure 204 can be an inclined structure (i.e., a chamfer structure), but the present invention is not limited thereto. For example, the pressing assistant structure 204 can be an arc structure (i.e., a round structure). As for which one of the aforesaid designs is adopted, it depends on practical demands.

Compared to the prior art, the slide rail assembly has advantages over the prior art by the following perspectives:

1. The holding member enables the slide rail assembly to be securely retained in the retracted status when the slide rail assembly is in the retracted position.

2. The holding member adopts an elastic engaging manner which is advantageous to the prior art in stability and reliability.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A slide rail assembly, comprising:

a first rail oriented along a longitudinal direction;

a second rail having an engaging portion; and a holding member mounted to the first rail, the holding member having an elastic section and a holding section, the holding section protruding from the elastic section by a height, the elastic section comprising a first elastic portion and a second elastic portion connected to the first elastic portion, the first elastic portion being oriented substantially along a transverse direction perpendicular to the longitudinal direction, the second elastic portion being oriented substantially along the longitudinal direction;

wherein the engaging portion of the second rail engages with the holding section of the holding member when the second rail is located in a retracted position relative to the first rail;

wherein the engaging portion of the second rail disengages from the holding section of the holding member when the second rail is moved away from the retracted position relative to the first rail.

2. The slide rail assembly of claim 1, wherein the engaging portion of the second rail is a hole.

3. The slide rail assembly of claim 2, wherein the second rail has a first edge wall and a second edge wall, the first edge wall and the second edge wall cooperatively define the hole, the holding section of the holding member has a first side and a second side, the first side corresponds to the first edge wall, and the second side corresponds to the second edge wall.

4. The slide rail assembly of claim 3, further comprising:

a first guiding structure disposed on one of the first edge wall of the second rail and the first side of the holding section of the holding member.

5. The slide rail assembly of claim 3, further comprising:

a second guiding structure disposed on one of the second edge wall of the second rail and the second side of the holding section of the holding member.

6. The slide rail assembly of claim 1, further comprising:

a third rail movably disposed between the first rail and the second rail, the third rail being for elongating an extracting movement of the second rail relative to the first rail.

7. The slide rail assembly of claim 6, wherein the first rail comprises a pair of first lateral walls and a first central wall, the first central wall is arranged between the pair of first lateral walls and connects one of the pair of first lateral walls with the other of the pair of first lateral walls, the pair of first lateral walls and the first central wall cooperatively define a first passage, the slide rail assembly further comprises:

a first sliding assistant device arranged in the first passage and mounted to the pair of the first lateral walls of the first rail, the first sliding assistant device has a plurality of rolling balls for facilitating the third rail to displace relative to the first rail.

8. The slide rail assembly of claim 7, wherein the holding member is securely mounted to the central wall of the first rail.

9. The slide rail assembly of claim 6, wherein the third rail comprises a pair of second lateral walls and a second central wall, the second central wall is arranged between the pair of second lateral walls and connects one of the pair of second lateral walls with the other of the pair of second lateral walls, the pair of second lateral walls and the second central wall cooperatively define a second passage, the slide rail assembly further comprises:

a second sliding assistant device arranged in the second passage and mounted to the pair of the second lateral walls of the third rail, the second sliding assistant device has a plurality of rolling balls for facilitating the second rail to displace relative to the third rail.

10. The slide rail assembly of claim 1, wherein the holding member is mounted at a position adjacent to a rear end of the first rail.

11. The slide rail assembly of claim 10, wherein the holding member has a base plate, the base plate is securely mounted at the position adjacent to the rear end of the first rail, and the elastic section of the holding member extends from the base plate.

12. The slide rail assembly of claim 1, wherein the holding member is an elastic member made of metal material.

13. The slide rail assembly of claim 6, wherein the holding member has a stop portion corresponding to a rear end of the third rail, and the stop portion is for stopping the third rail when the third rail is located in the retracted position relative to the first rail.

* * * * *